US011191699B1

(12) United States Patent
Masini et al.

(10) Patent No.: US 11,191,699 B1
(45) Date of Patent: Dec. 7, 2021

(54) PERSONAL THERMOELECTRIC-COOLING AND HEATING CASE

(71) Applicant: Masinovation Industries Corporation, Berwyn, IL (US)

(72) Inventors: Mark Anthony Masini, Glenview, IL (US); Bradley Garrett Rash, Raymore, MO (US)

(73) Assignee: MASINOVATION INDUSTRIES CORPORATION, Berwyn, IL (US)

( * ) Notice: Subject to any disclaimer, the term of this patent is extended or adjusted under 35 U.S.C. 154(b) by 0 days.

(21) Appl. No.: 17/211,122

(22) Filed: Mar. 24, 2021

Related U.S. Application Data

(60) Provisional application No. 63/115,341, filed on Nov. 18, 2020.

(51) Int. Cl.

| | |
|---|---|
| ***A61J 1/16*** | (2006.01) |
| ***F25B 21/02*** | (2006.01) |
| ***B65D 81/38*** | (2006.01) |

(52) U.S. Cl.
CPC ..... *A61J 1/165* (2013.01); *B65D 81/38* (2013.01); *F25B 21/02* (2013.01); *A61J 2200/42* (2013.01); *A61J 2200/44* (2013.01); *A61J 2200/50* (2013.01)

(58) Field of Classification Search
CPC .... A61J 1/165; A61J 2200/42; A61J 2200/44; A61J 2200/50; B65D 81/38; F25B 21/02; F25B 21/04; F25B 2321/0251; F25B 2321/023; F25B 2321/805; F25B 2321/804
See application file for complete search history.

(56) References Cited

U.S. PATENT DOCUMENTS

| | | | | |
|---|---|---|---|---|
| 8,225,616 | B2 | 7/2012 | Wilkinson et al. | |
| 10,071,019 | B2 | 9/2018 | Lüpges | |
| 10,722,427 | B2 | 7/2020 | Cantor | |
| 2015/0305979 | A1 | 10/2015 | Tintinger | |
| 2020/0224964 | A1* | 7/2020 | Alexander | F25D 31/006 |

FOREIGN PATENT DOCUMENTS

| | | | |
|---|---|---|---|
| EP | 2 427 236 | A2 | 3/2012 |
| EP | 3156088 | B1 | 3/2018 |
| WO | 2010/128493 | A2 | 11/2010 |

* cited by examiner

*Primary Examiner* — Elizabeth J Martin
(74) *Attorney, Agent, or Firm* — Buchanan Ingersoll & Rooney PC

(57) ABSTRACT

A personal thermoelectric-cooling and heating case includes a first rigid chamber and a temperature regulated second rigid chamber. The first rigid chamber accommodates electronic circuitry. The first rigid chamber also extends lengthwise along a longitudinal axis and includes a first end portion, a second end portion, and a thermoelectric-cooling device. The temperature regulated second rigid chamber includes a bay structure configured to accommodate an item that is subject to temperature regulation. The temperature regulated second rigid chamber (i) extends lengthwise along a longitudinal axis and includes a first end portion and a second end portion, (ii) is coupleable to the first rigid chamber in a lengthwise direction, and (iii) includes a direct heating element thermally coupled to the bay structure. The first rigid chamber and the temperature regulated second rigid chamber together form a housing.

19 Claims, 18 Drawing Sheets

100

100

200

300

PERSONAL THERMOELECTRIC-COOLING AND HEATING CASE

FIELD

The present disclosure relates to a portable thermoelectric-cooling and heating case that holds an object, such a medical device, medicaments, etc. and regulates a temperature of the object to maintain recommended storage temperature conditions.

BACKGROUND

Certain medical conditions require regular administration of medications. Other physical conditions may also require the repeated administration of medication either temporarily or on a lifetime basis. Some medications, however, are subject to degradation of storage life (e.g., lifespan), efficacy, potency, and even safety (i.e., they may become toxic) if they are not stored properly. For example, exposure to light, humidity, temperature, etc. may have an adverse effect on certain medications. In fact, drug manufacturers may provide explicit user instructions regarding storage of medications. For example, users may be instructed to store medications at room temperature, to not expose medications to extreme cold or heat, to store medications in a refrigerator, to protect medications from light, etc. Even further, because of the sensitivity of certain medications, mobility of the users who use these medications may be limited. As such, these types of medications require not only storage in a temperature-regulated environment, but such storage must be portable. However, existing storage apparatuses for regulating the temperature of medications are generally bulky, are difficult to transport and/or are functionally limited.

Thus, a need exists for a technical solution for providing a thermoelectric-cooling and heating case that is not only configured to regulate the temperature of an object (e.g., medication) stored therein, but that is also easily transportable.

SUMMARY

The present disclosure provides a description of a system and method for regulating temperature of a personal and portable thermoelectric-cooling and heating case.

A personal thermoelectric-cooling and heating case includes a first rigid chamber configured to accommodate electronic circuitry. The first rigid chamber extends lengthwise along a longitudinal axis and includes a first end portion, a second end portion, and a thermoelectric-cooling device. The personal thermoelectric-cooling and heating case also includes a temperature regulated second rigid chamber that includes a bay structure configured to accommodate an item that is subject to temperature regulation. The temperature regulated second rigid chamber (i) extends lengthwise along a longitudinal axis and includes a first end portion and a second end portion, (ii) is coupleable to the first rigid chamber in a lengthwise direction, and (iii) includes a direct heating element thermally coupled to the bay structure. The first rigid chamber and said temperature regulated second rigid chamber together form a housing.

A method of regulating temperature of a personal thermoelectric-cooling and heating case, the method includes coupling a first rigid chamber, configured to accommodate electronic circuitry, to a temperature regulated second rigid chamber in a lengthwise direction, wherein the first rigid chamber extends lengthwise along a longitudinal axis and includes a first end portion, a second end portion, and a thermoelectric-cooling device. The temperature regulated second rigid chamber (i) includes a bay structure configured to accommodate an item that is subject to temperature regulation, (ii) extends lengthwise along a longitudinal axis and includes a first end portion and a second end portion, and (iii) includes a direct heating element thermally coupled to the bay structure. The method also includes measuring, by a thermistor, a temperature of the bay structure of the temperature regulated second rigid chamber, wherein the thermistor is in thermal contact with the bay structure.

BRIEF DESCRIPTION OF THE DRAWING FIGURES

The scope of the present disclosure is best understood from the following detailed description of exemplary embodiments when read in conjunction with the accompanying drawings. Included in the drawings are the following figures.

Further areas of applicability of the present disclosure will become apparent from the detailed description provided hereinafter.

DETAILED DESCRIPTION

References are made herein to the attached figures. Like reference numbers are used throughout the figures to depict like or similar elements of the personal thermoelectric-cooling and heating device. It should be understood that the detailed description of exemplary embodiments are intended for illustration purposes only and are, therefore, not intended to necessarily limit the scope of the disclosure.

Figure 1:
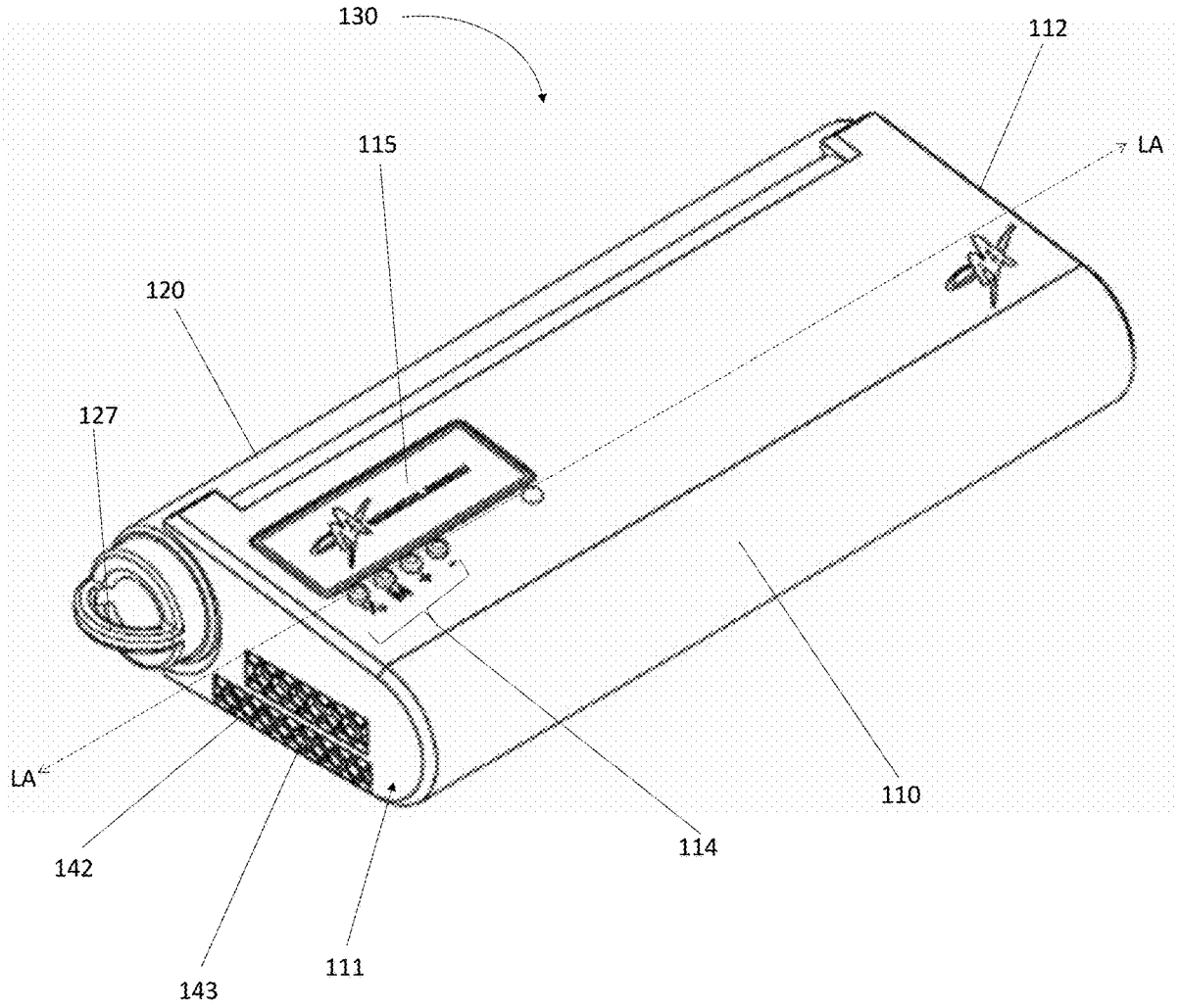
FIG. 1 illustrates a perspective view of a personal thermoelectric-cooling and heating case in accordance with exemplary embodiments.

FIG. 1 depicts a perspective view of a personal, hand-held, pocket sized thermoelectric-cooling and heating case 100 in accordance with exemplary embodiments. The personal thermoelectric-cooling and heating case 100 includes a first rigid chamber 110 and a temperature regulated second rigid chamber 120 that is removeably coupleable to the first rigid chamber 110.

The First Rigid Chamber

Figure 2:
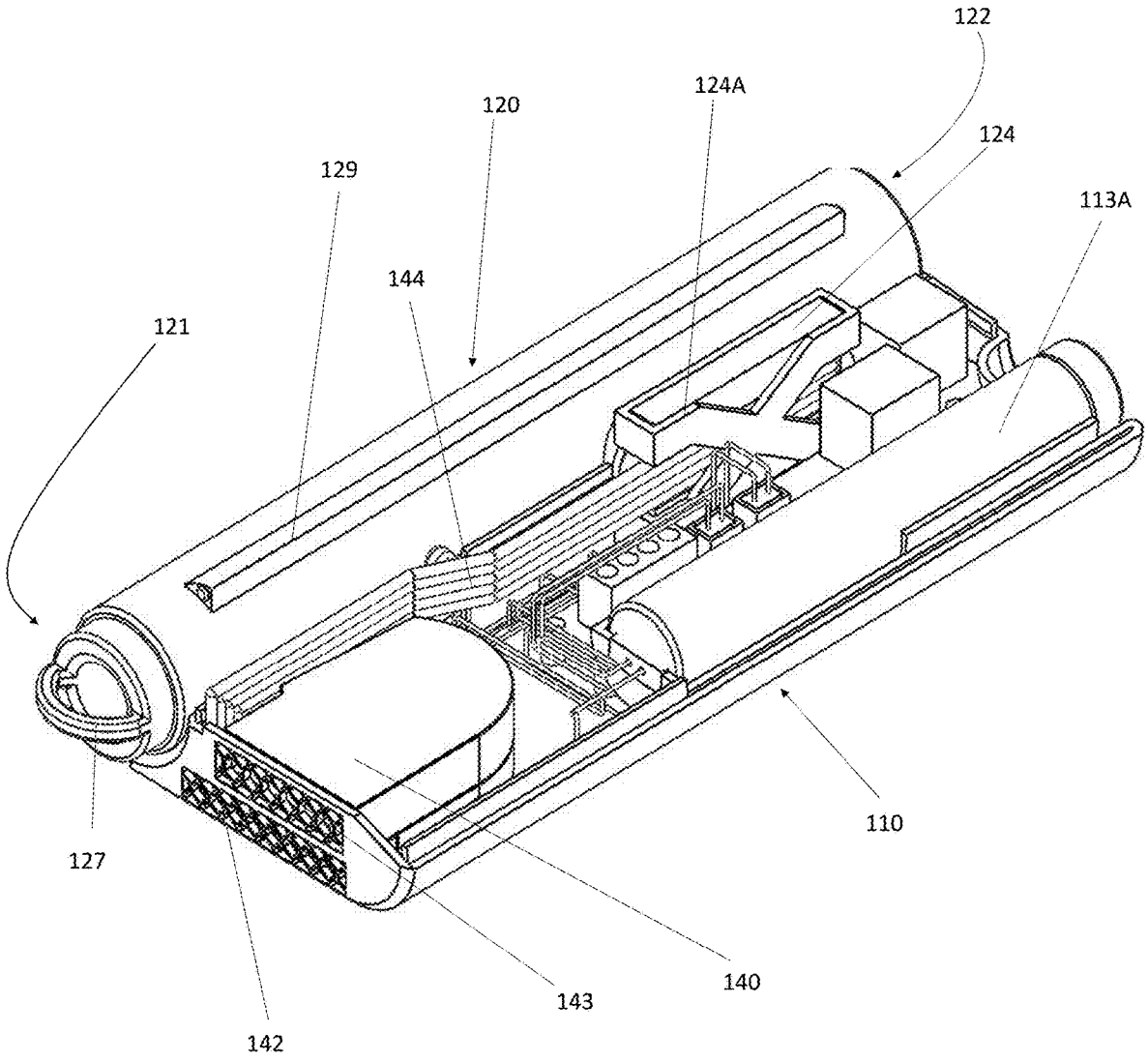
FIG. 2 illustrates an internal view of a first rigid chamber of the personal thermoelectric-cooling and heating case of FIG. 1 in accordance with exemplary embodiments.
Figure 10:
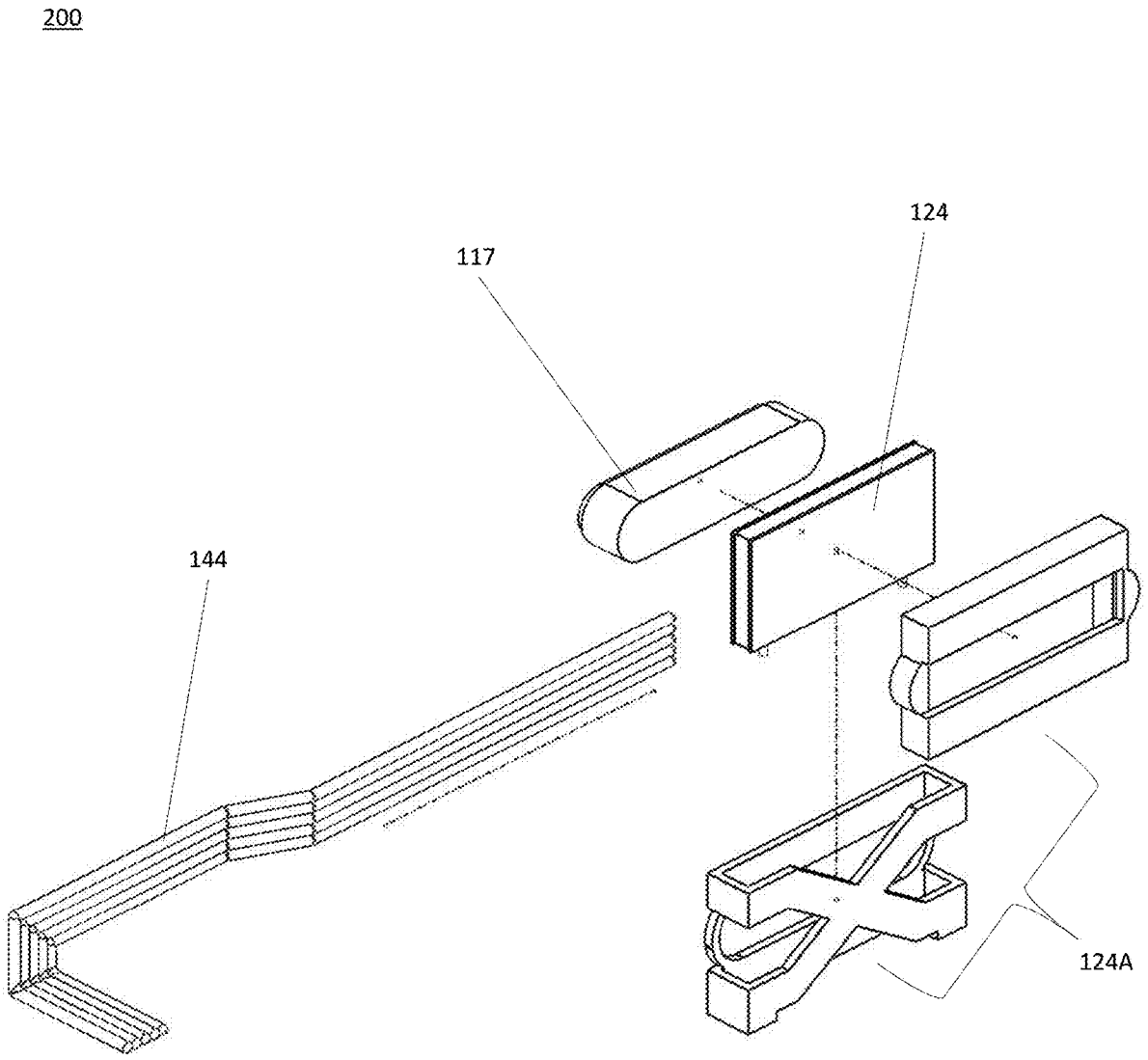
FIG. 10 illustrates an exploded view of the cooling weldment of FIG. 9 in accordance with exemplary embodiments.
Figure 11:
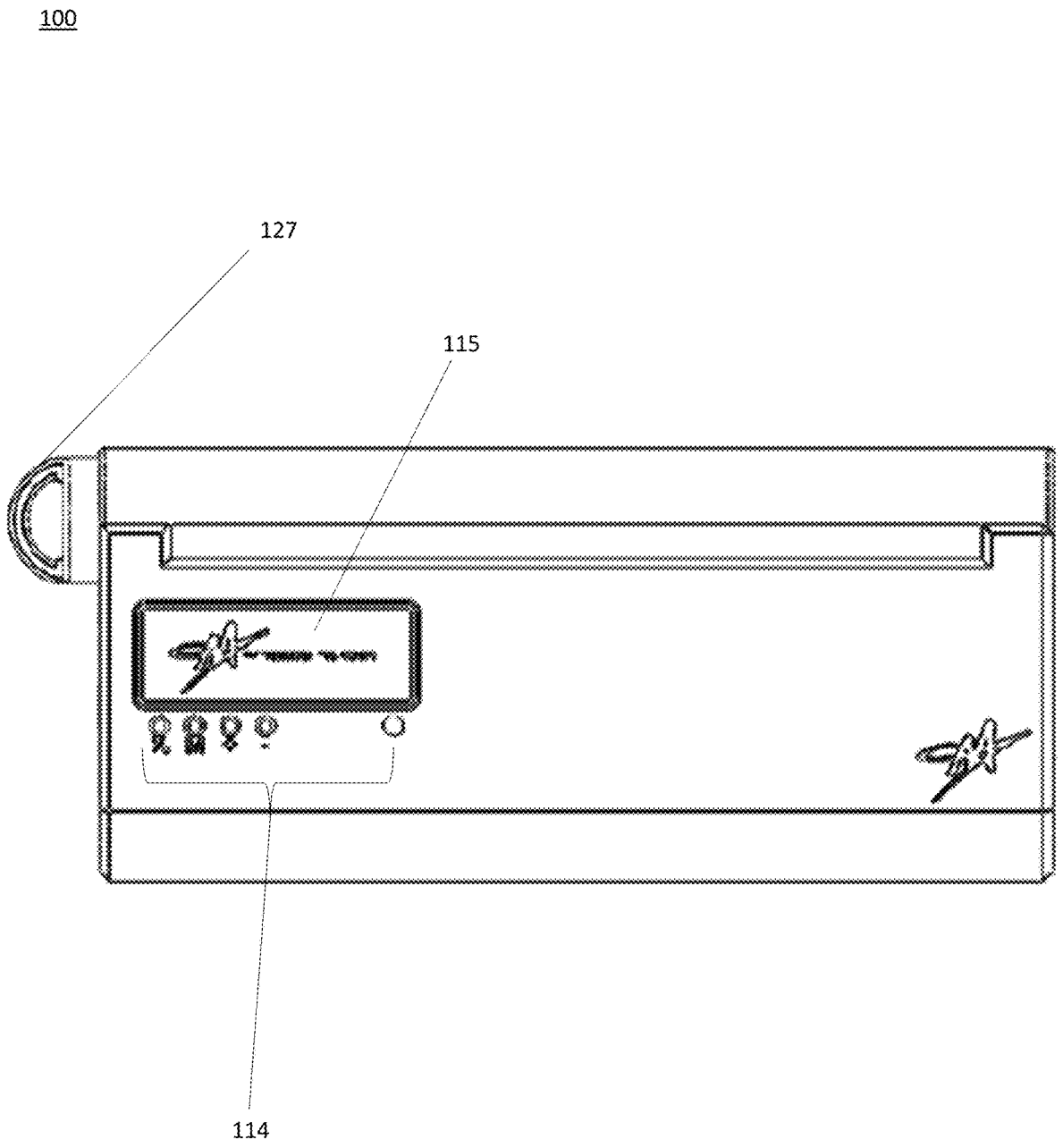
FIG. 11 illustrates a top view of the personal thermoelectric-cooling and heating case of FIG. 1 in accordance with exemplary embodiments.
Figure 12:
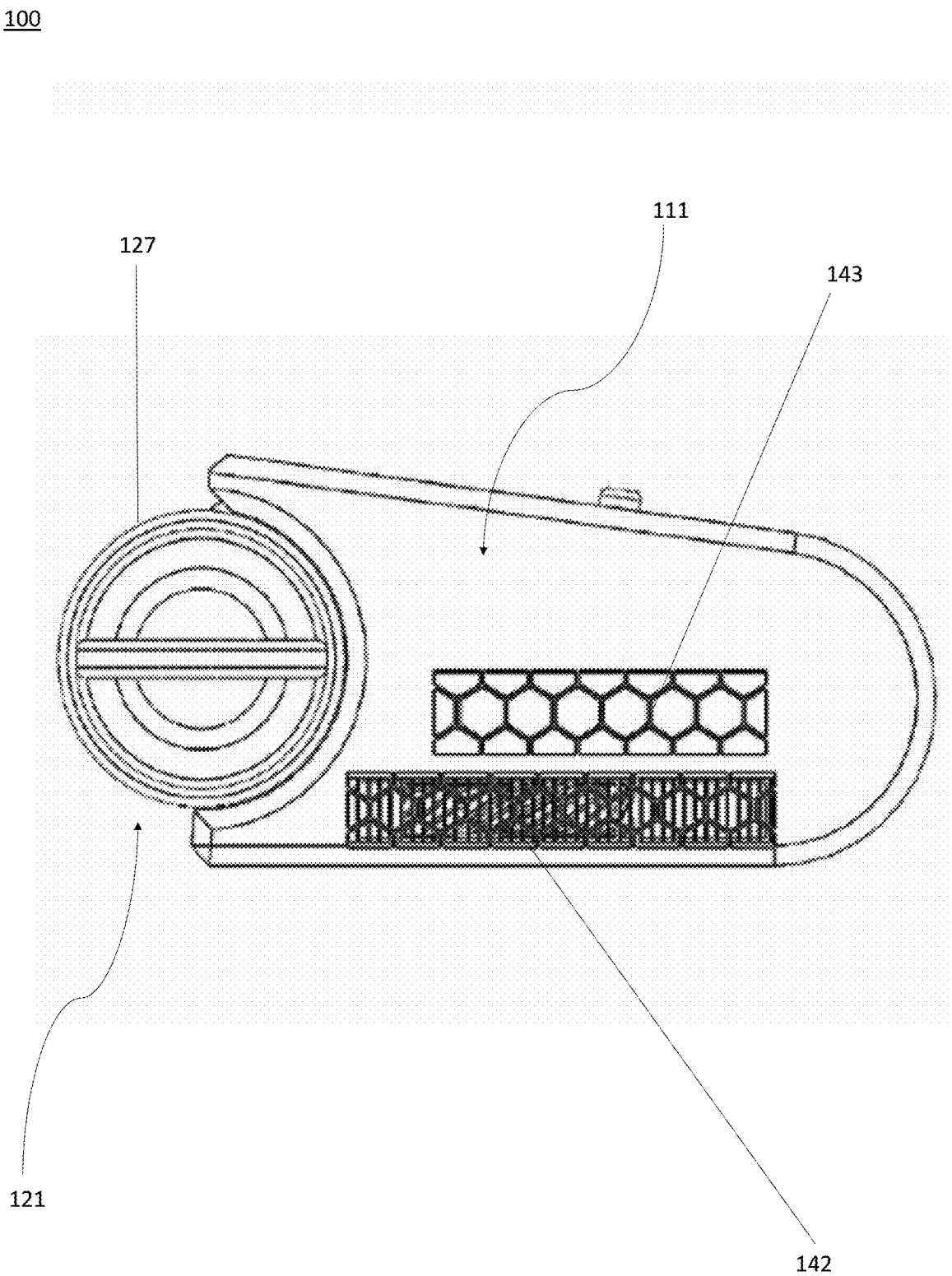
FIG. 12 illustrates a front view of the personal thermoelectric-cooling and heating case of FIG. 1 in accordance with exemplary embodiments.
Figure 13:
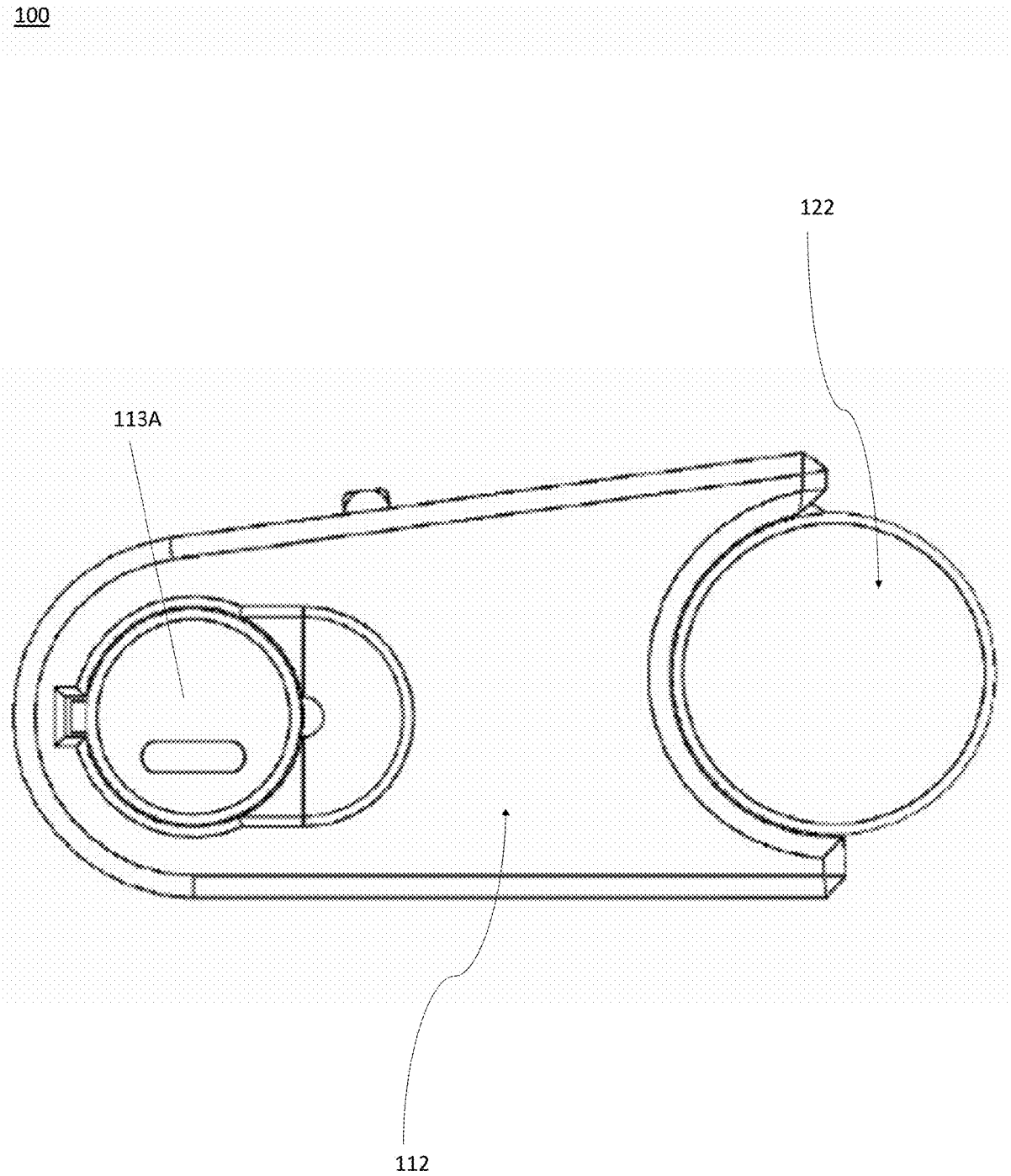
FIG. 13 illustrates a back view of the personal thermoelectric-cooling and heating case of FIG. 1 in accordance with exemplary embodiments.
Figure 14:
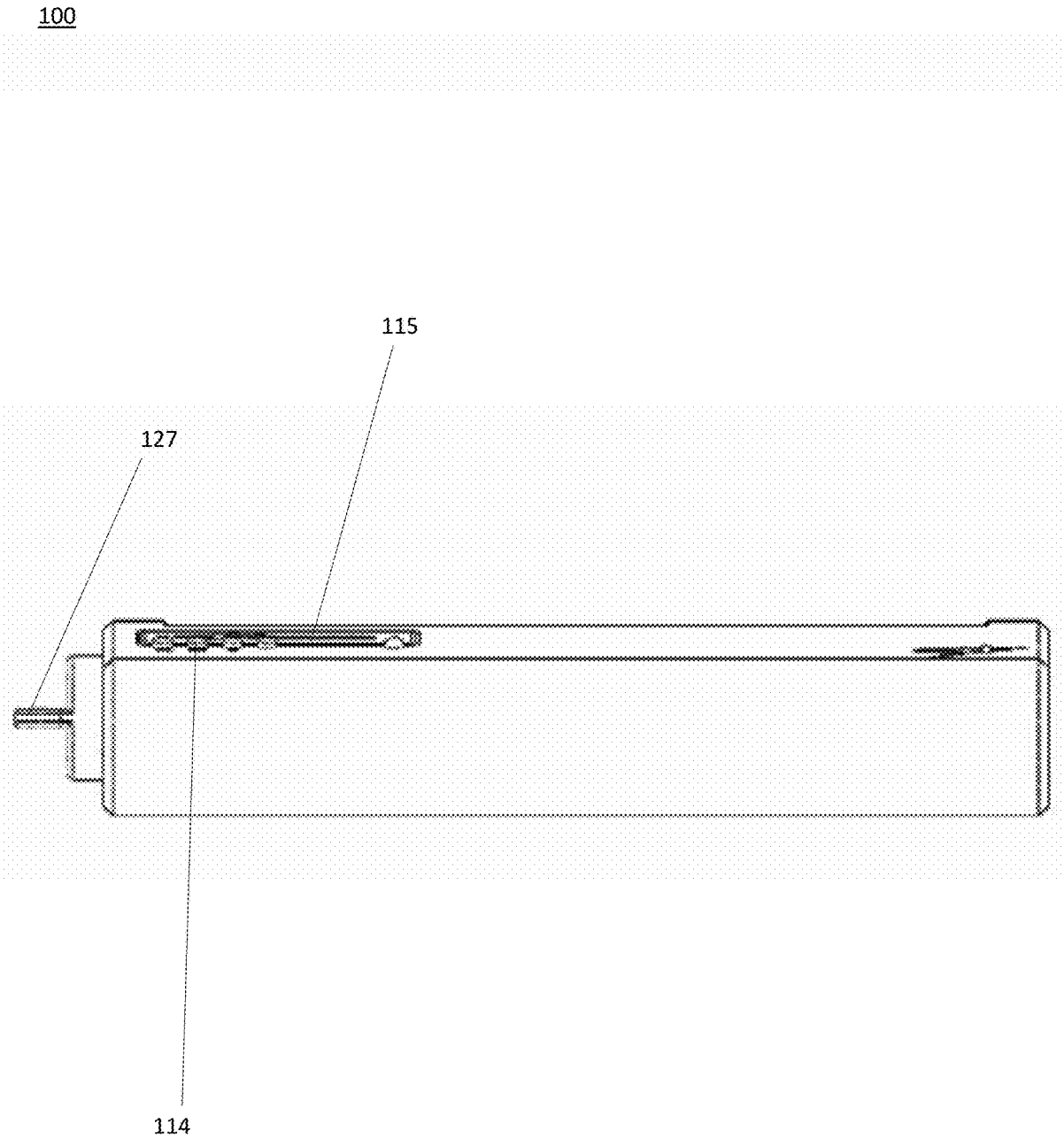
FIG. 14 illustrates a right side view of the personal thermoelectric-cooling and heating case of FIG. 1 in accordance with exemplary embodiments.
Figure 15:
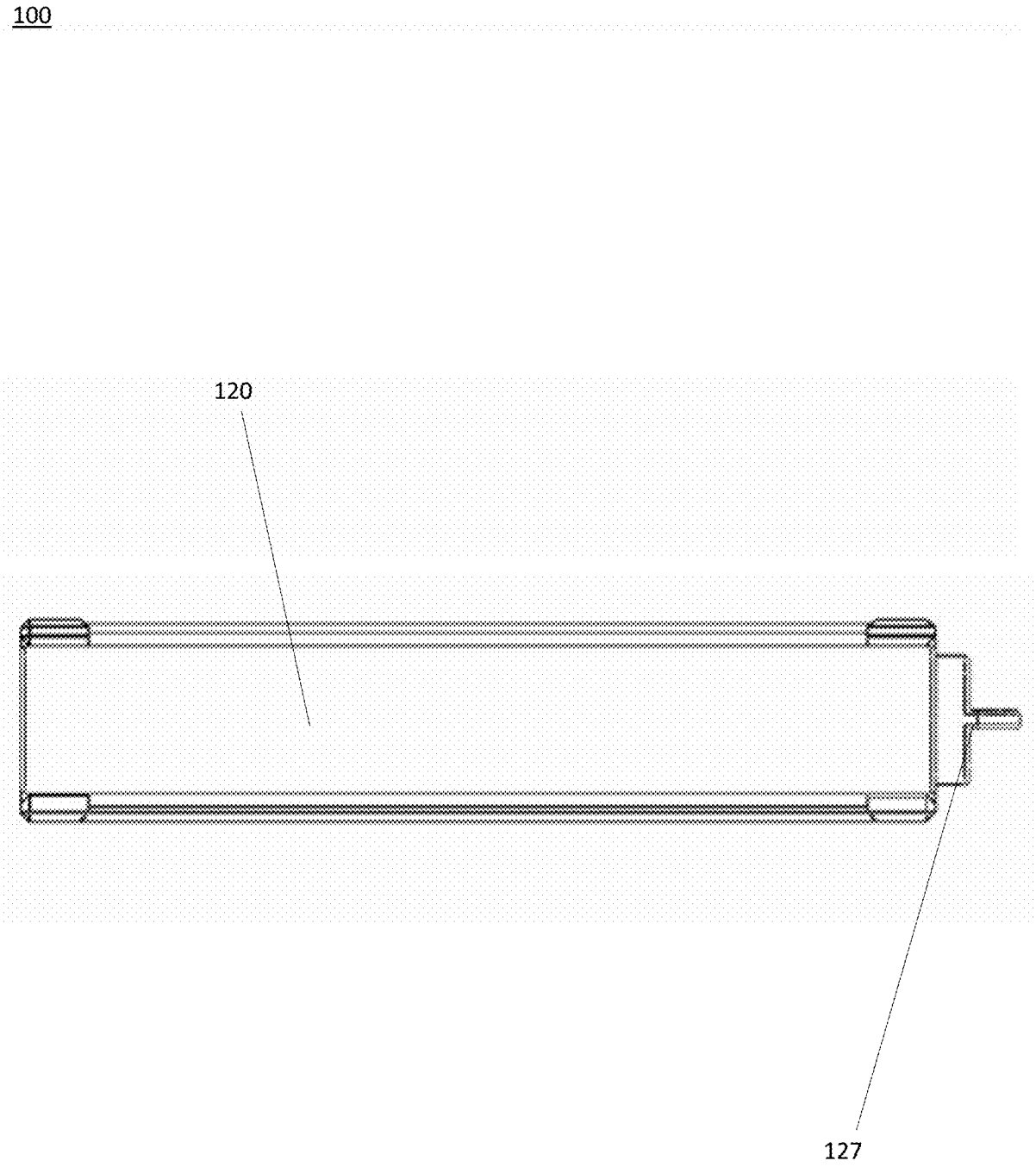
FIG. 15 illustrates a left side view of the personal thermoelectric-cooling and heating case of FIG. 1 in accordance with exemplary embodiments.

The first rigid chamber 110 extends lengthwise along a longitudinal axis LA and is configured to accommodate electronic circuitry. The first rigid chamber 110 includes a first end portion 111, a second end portion 112, a processor 119 (shown in FIG. 11), input devices 114, a display 115, a cooling weldment 200 (shown in FIGS. 9 and 10), and a fan assembly 140 (shown in FIGS. 2-4).

The processor 119 (discussed in more details herein) of the first rigid chamber 110 is the logic circuitry that responds to and processes instructions and/or commands that drive the thermoelectric-cooling and heating case 100. The processor 119 communicates with each electronic component of the thermoelectric-cooling and heating case 100 and controls their respective functions (as discussed in more detail herein).

Figure 17:
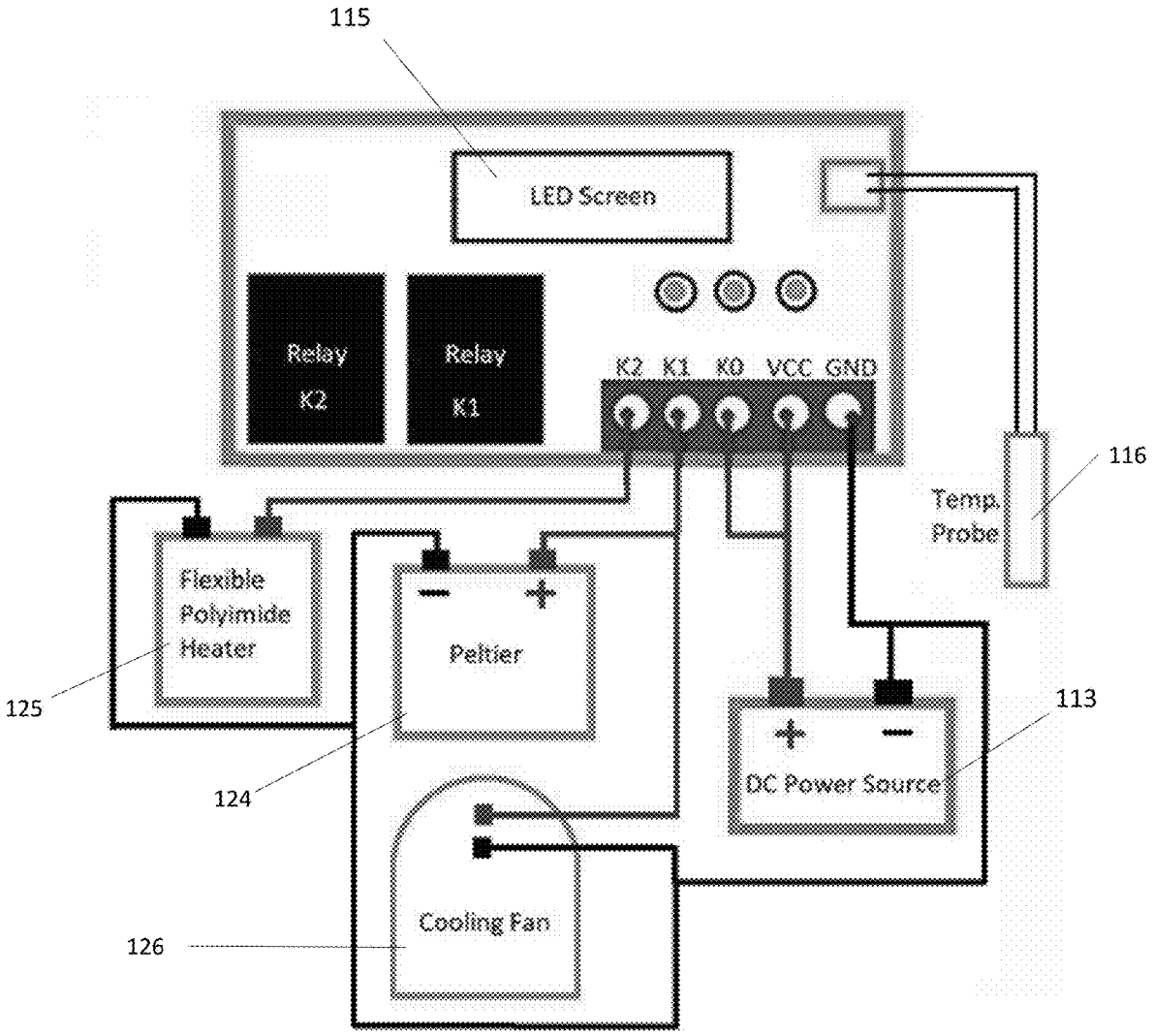
FIG. 17 illustrates a circuit diagram of the personal thermoelectric-cooling and heating case of FIG. 1 in accordance with exemplary embodiments.

The input devices 114 and display 115 (see, e.g., FIGS. 1, 5, 6, 8 and 11) are located on a top portion of the first rigid chamber 110. The input devices 114 are configured to receive input from a user (e.g., owner, medical staff, technician, etc.) for a power setting (e.g., on, off, etc.) of the personal thermoelectric-cooling and heating case 100, for setting a temperature and or temperature range of a bay structure 123 of the temperature regulated second rigid chamber 120 (described in more detail herein), increasing or decreasing the set temperature or temperature range, initiating rapid cooling setting in which maximum power is used and temperature is reduced an additional 10 degrees Fahrenheit, for emergency (e.g., 911) calling or texting, etc. The input devices 114 may be separate from the display 115 and include manual buttons (e.g., a keyboard), switches, levers, etc., for receiving the user inputs. Alternatively, the display 115 may include the input devices. For example, the display 115 may be a liquid crystal display (LCD) or organic light-emitting diode (OLED) display (see, e.g., FIG. 17) including a touch screen interface configured to receive a touch input from a user using his/her finger or stylus. The display 115 is further configured to display features and/or setting of the thermoelectric-cooling and heating case 100. For example, the display 115 may display the current temperature and desired temperature (or temperature range) of the bay structure 123. It may display the current time, a battery meter/battery level indicator, a name of the item housed in the bay structure 123, etc.

The cooling weldment 200 includes a thermoelectric-cooling device 124 (shown in FIGS. 2-4, 9 and 10), a jacket/sleeve 124A for housing the thermoelectric-cooling device 124, a conductive element 117 (e.g., a copper block), and a heat dissipating structure 144 (e.g., heat pipes).

The thermoelectric-cooling device 124 may be a Peltier heat pump configured to cool the bay structure 123 and, thus, cool an item within the bay structure 123. In one embodiment, the Peltier heat pump may be a single Peltier (as shown in FIGS. 2-4, 9, 10 and 17). In another embodiments, it may be multiple Peltiers that are stacked to achieve lower temperatures (e.g., down to as low as negative 158 degrees Celsius). In yet other embodiments, multiple Peltiers may be used in a side-by-side configuration to create a larger surface area for cooling.

The conductive element 117 is in thermal contact, via, e.g., a thermal paste, with the thermoelectric-cooling device 124 and is configured to be inserted through a hole 128A of the temperature regulated second rigid chamber 120 and a hole 128C of the bay structure 123. The conductive element 117 is configured to transfer heat from the bay structure 123 to the thermoelectric-cooling device 124 in order to cool the bay structure 123.

Figure 9:
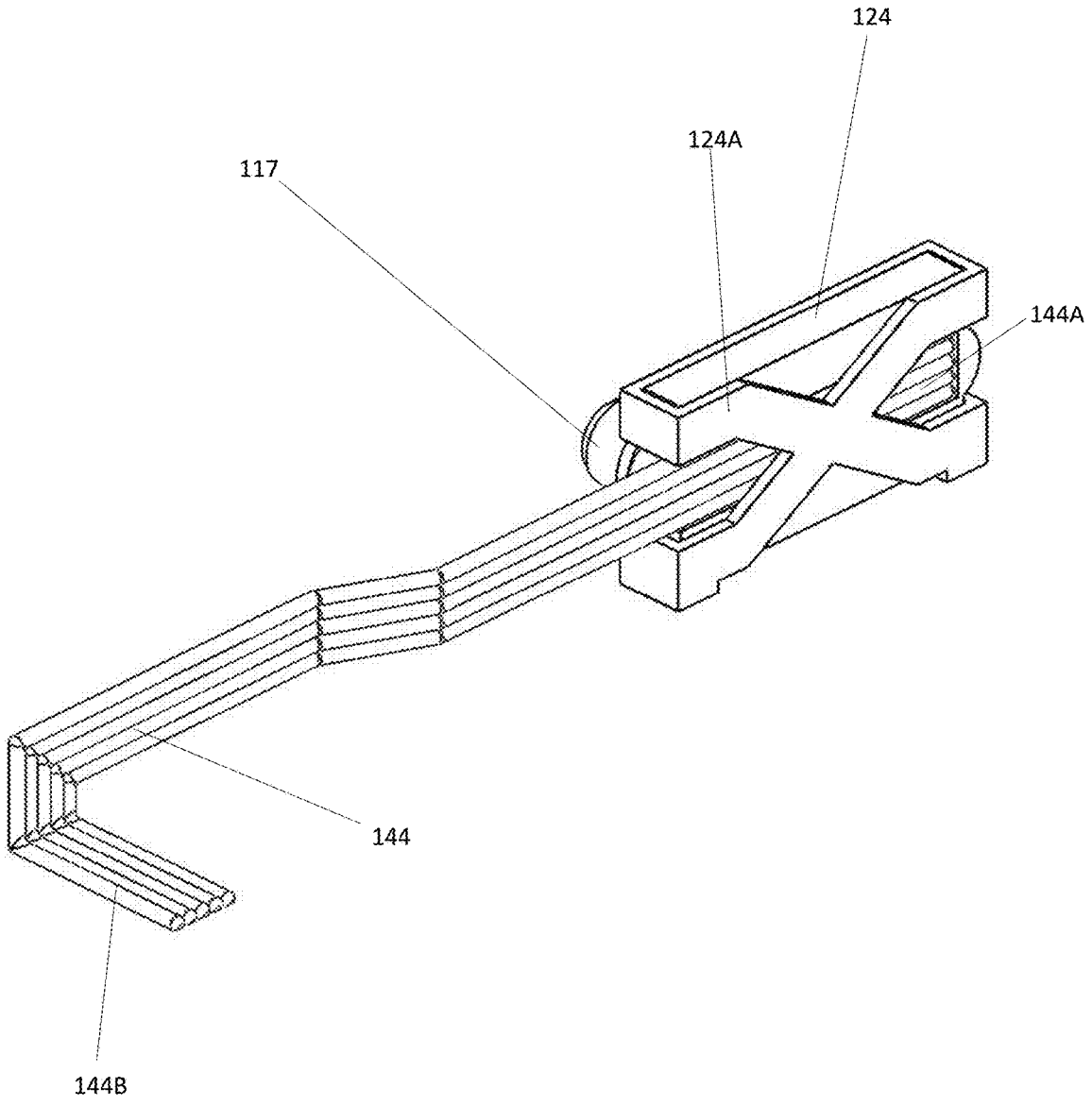
FIG. 9 illustrates a cooling weldment of the personal thermoelectric-cooling and heating case of FIG. 1 in accordance with exemplary embodiments.

The heat dissipating structure 144 (e.g., heat pipes) includes a first end portion 144A and a second end portion 144B (shown in FIG. 9). The first end portion 144A of the heat dissipating structure 144 is in thermal contact with the thermoelectric-cooling device 124, via a thermal paste, and is configured to remove heat from the thermoelectric-cooling device 124. The heat dissipating structure 144 transfers the removed heat from the first end portion 144A thereof to the second end portion 144B thereof, which is inserted into a portion of the fan assembly 140.

The fan assembly 140 (shown in FIGS. 2-4 and 17) of the first rigid chamber 110 includes an air intake 143 and an exhaust 142 and may include an internal fan 141, blower style fan, etc. (see, e.g., FIG. 4). When activated by the processor 119, the fan assembly is configured to pull air from the air intake 143 and blow air onto the second end portion 144B of the heat dissipating structure 144 to remove heat therefrom. The blown air is then removed from the fan assembly 140 via the exhaust 142.

Figure 6:
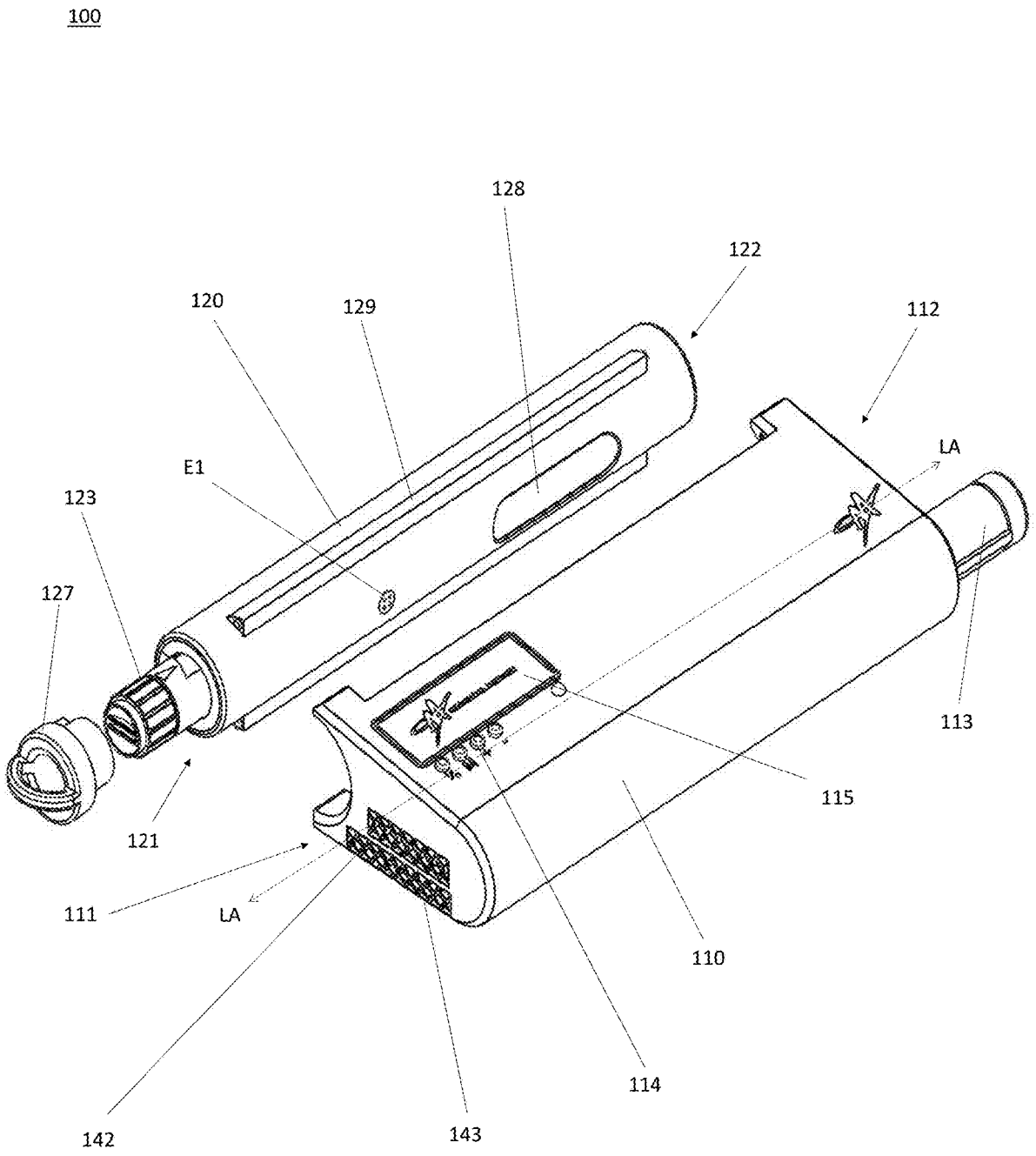
FIG. 6 illustrates the exploded perspective view of the personal thermoelectric-cooling and heating case of FIG. 2 with a removeable battery, in accordance with exemplary embodiments.

The first rigid chamber 110 is also configured to receive (and house, via a battery holder 113A shown in FIGS. 2-4 and 13) a removeable battery 113 (see also FIG. 17) at the second end portion 112 thereof, as shown in FIG. 6. The removeable battery 113 may be disposable or rechargeable. In some embodiments, the removeable battery 113 may be one or more lithium ion batteries that may be rechargeable via a universal serial bus (USB) connection, an external transformer, or other external power source. In other embodiments, the removeable battery 113 may be rechargeable via a solar charging inverter, wireless charging, or wireless powershare (e.g., charge from another electronic device, such a phone, tablet, etc.) or combinations of these different recharging sources.

The memory (not depicted) included in the processor 119 of the first rigid chamber 110 is configured to store temperature data associated with the temperature regulation of the bay structure 123 of the temperature regulated second rigid chamber 120. In some embodiments, the stored temperature data may include a single temperature as inputted by a user via the input devices 114. In other embodiments, the stored temperature data may include a range of temperatures. In such embodiments, for example, the range of temperatures may include a first threshold value (e.g., a minimum temperature value) and a second threshold value (e.g., a maximum temperature value). Another alternative is to have a controlled temperature in a range over time, such as no longer cooling and/or warming the chamber before scheduled use or activation of a temperature change by user through the input devices 114 or opening of the second rigid chamber 120 using a sensor device 128 (described below), as might be desirable or appropriate for the item or material being stored.

The Temperature Regulated Second Rigid Chamber

The temperature regulated second rigid chamber 120 of the thermoelectric-cooling and heating case 100 extends in a lengthwise direction along a longitudinal axis of the thermoelectric-cooling and heating case and is coupleable to the first rigid chamber 110 in the lengthwise direction. In some embodiments, the first rigid chamber 110 and the temperature regulated second rigid chamber 120 are removeably coupleable via a snap-type mechanism. In particular, in such embodiments, the first rigid chamber 110 and the temperature regulated second rigid chamber 120 may be formed of parts that snap together through interlocking flanges, or the like, to prevent casual opening. For example, the temperature regulated second rigid chamber 120 may include a female component configured to receive a male component of the first rigid chamber 110.

The first rigid chamber 110 and the temperature regulated second rigid chamber 120, when coupled together, form a housing 130. In some embodiments, the housing 130, formed by the first rigid chamber 110 and the temperature regulated second rigid chamber 120, is a contiguous structure. In other embodiments, the housing 130 is a bifurcated structure with a first part formed by the first rigid chamber 110 and a second part formed by the temperature regulated second rigid chamber 120. In yet other embodiments, the housing 130 may be a clamshell design with bias hinges to maintain it in an open position once opened past a certain point, and otherwise biasing the two halves together to close the housing 130 and protect its contents.

The housing 130, formed by the first rigid chamber 110 and the temperature regulated second rigid chamber 130, is a solid, rigid, self-contained shell. In preferred embodiments, the housing 130 does not utilize any soft, mesh, or flexible encasements as supporting structure. However, in some embodiments, the housing 130 may be encased in a removeable decorative and/or softening cover. The housing 130 (and thus the first rigid chamber 110 and the temperature regulated second rigid chamber 130) may be injection molded or machined. The housing 130 may further be water and fire-proof or resistant.

As shown in FIGS. 2-7, the temperature regulated second rigid chamber 120 includes a first end portion 121, a second end portion 122, an elevated ridge 129, the bay structure 123, a thermistor 116 (shown in FIGS. 3, 4, 7, and 11), and a direct heating element 125. The temperature regulated second rigid chamber 120 also defines a first hole 128A configured to receive the conductive element 117 of the cooling weldment 200 and a second hole 128*b* configured to receive an electrical contact E1.

The first end portion 121 of the temperature regulated second rigid chamber 120 is configured to receive the bay structure 123 (see, e.g., FIG. 7) such that it is housed within. The first end portion 121 further includes a removeable cap 127 (shown in FIGS. 1, 2, 5, 6 and 8) that is configured to cover the bay structure 123 and, for example, enable the removal of an item (e.g., medicament) accommodated therein with little thermal loss. In some embodiments, the cap 127 may include threading or other twist closing structure. In other embodiments, the cap 127 may be a friction fit cap. In yet other embodiments, the cap may a hinged cap with a latch, such as a snap lock or spring to keep it in a closed position, etc. End cap designs are not limited to the above-disclosed embodiments. Other end cap designs and/or types would be readily apparent to those skilled in the art. As an alternative to the cap 127 type of design, an elongated door (not depicted) can be placed on a side portion of the temperature regulated second rigid chamber 120 such that the item can be taken out by a motion perpendicular to an axis of the item. In some embodiments, the first end portion 121 of the temperature regulated second rigid chamber 120 may further include a cap seat sensor (not depicted) configured to detect when the cap is in an open or closed state and may trigger an alarm when the cap has been in an open state for a predetermined period of time.

The elevated ridge 129 of the temperature regulated second rigid chamber 120 (shown in FIGS. 2, 5 and 6) extends in a lengthwise direction on at least a portion of an external surface of the temperature regulated second rigid chamber between the first end portion 121 and the second end portion 122 of the temperature regulated second rigid chamber 120. The elevated ridge 129 is configured to demonstrate alignment and prevent rolling of the temperature regulated second rigid chamber 120 (when not connected to the first rigid chamber 110) on an external surface (e.g., a table, counter, etc.).

The bay structure 123 of the temperature regulated second rigid chamber 120 and is configured to accommodate an item that is subject to temperature regulation (e.g., insulin pens, insulin vials, vaccines, epinephrine other medications and materials, etc.). For example, in some embodiments, the bay structure 123 may be shaped and dimensioned as a tube to hold vials or an injection pen, e.g., in the case of insulin and/or vaccines. Alternative embodiments allow for multiple items, either by enlarging the temperature regulated second chamber or duplicating it for inclusion with the bay structure or structures 123 that can be coupled with the first rigid chamber 110.

The bay structure 123 extends between the first end portion 121 and the second end portion 122 of the temperature regulated second rigid chamber 120 and is comprised of a heat conductive element, for example, copper, other metals or nearly any other heat conductive materials. The bay structure 123 defines a hole 128C, which is aligned with the hole 128A defined in the temperature regulated second rigid chamber 120. The hole 128C is configured to receive the conductive block 117 of the thermoelectric-cooling device 124. The bay structure 123 is also configured to be in thermal contact with the thermistor 116 and the direct heating element 125 for regulating the temperature of the bay structure 123 (and an item accommodated within). The bay structure 123 may further be wrapped or otherwise covered in a thermal material.

The bay structure 123 may further include a sensor device 128 (see, e.g., FIG. 16) configured to detect when an item has been removed from the bay structure 123. When the sensor device 128 detects that item has been removed (e.g., an item is not housed within the bay structure 123), it transmits a signal to the processor 119, which then causes the thermoelectric-cooling device 124 and the direct heating element 125 to cease heating or cooling the bay structure 123.

In some embodiments, the bay structure 123 may include a spring-loading mechanism, such that an item is "spring-loaded" into the bay structure 123, and when the cap 127 is removed, the item within the bay structure springs up and slightly out of the bay structure 123.

Figure 3:
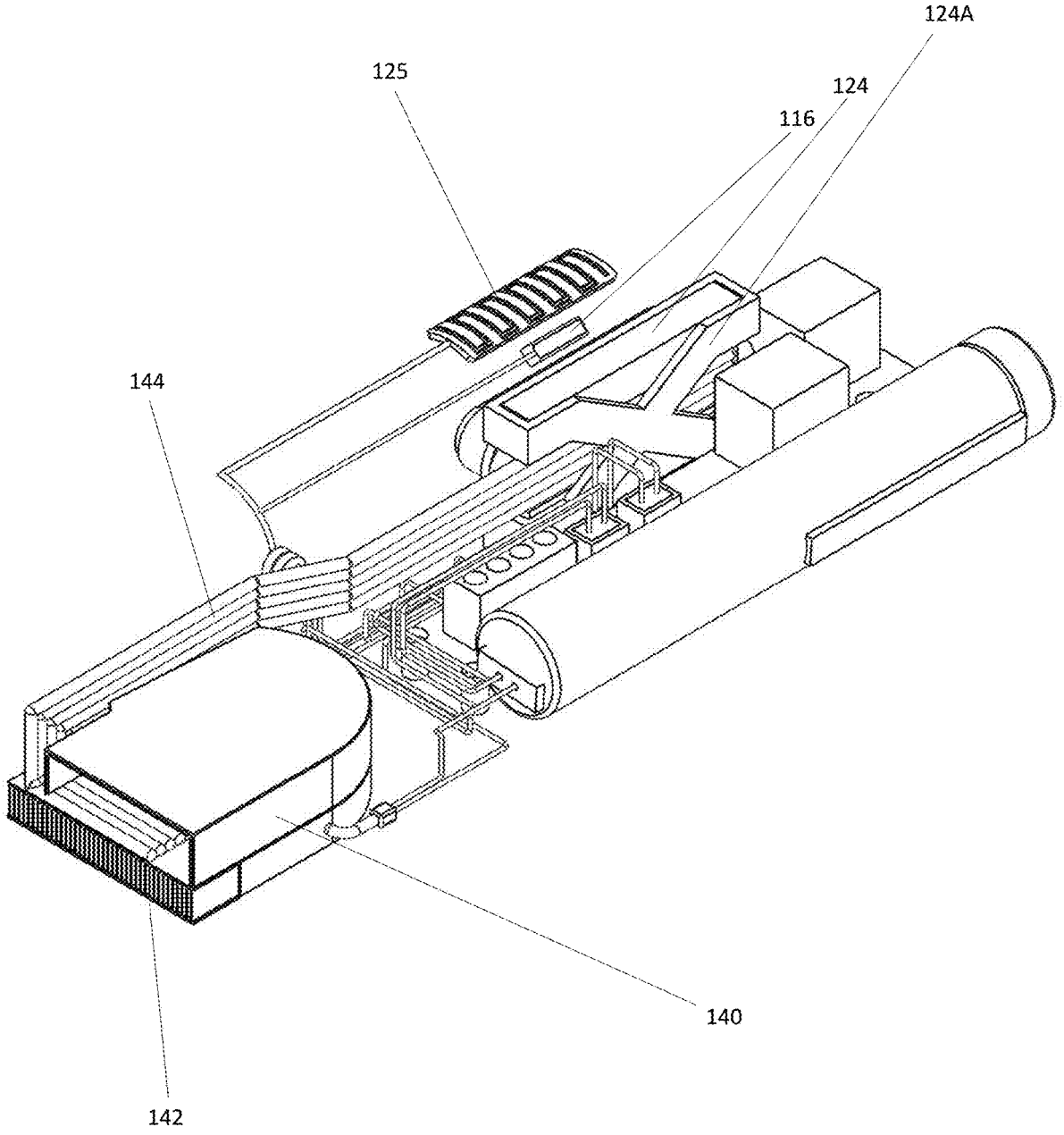
FIG. 3 illustrates the electronics of the personal thermoelectric-cooling and heating case of FIG. 1 in accordance with exemplary embodiments.
Figure 4:
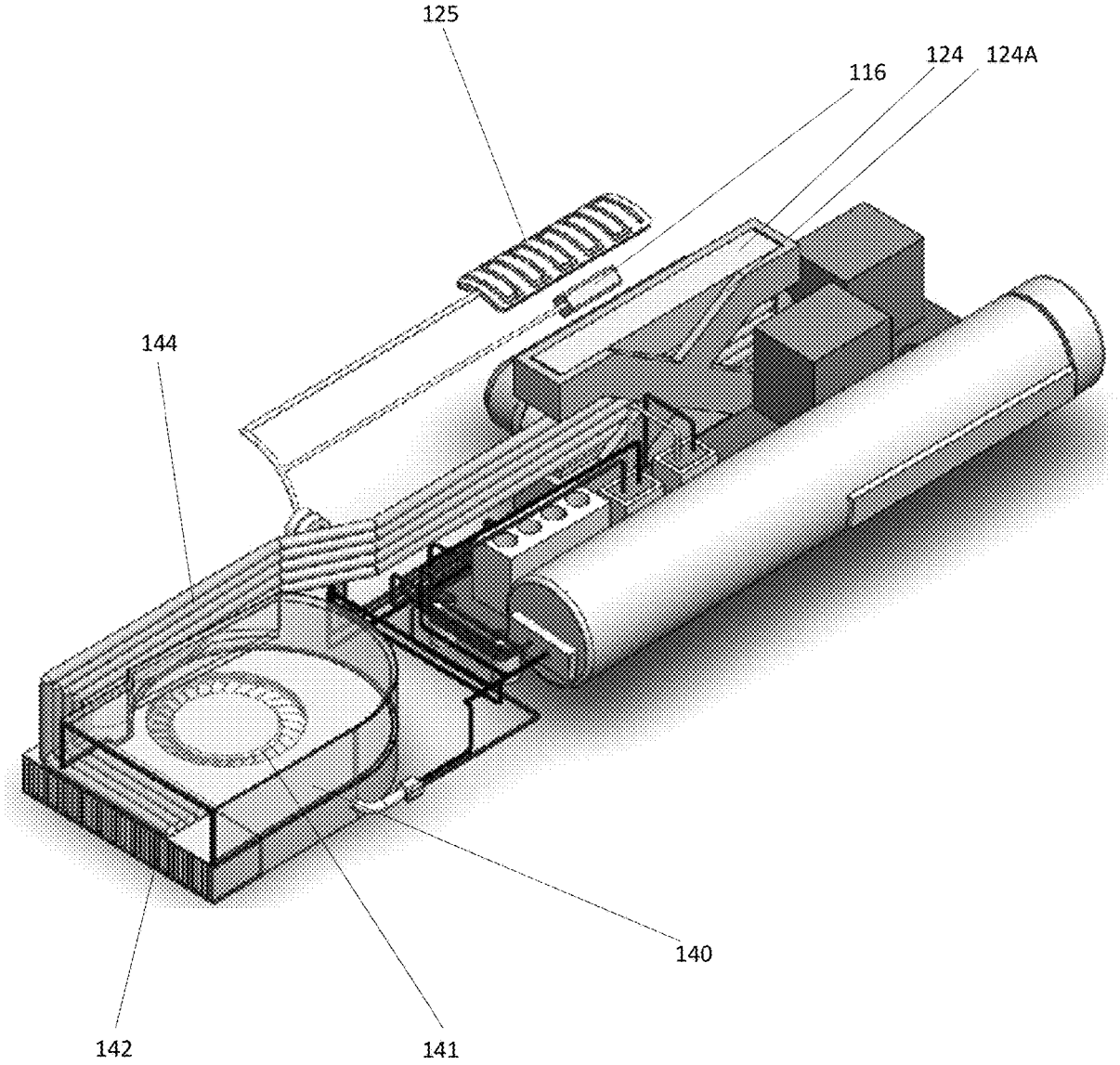
FIG. 4 illustrates another view of the electronics of the personal thermoelectric-cooling and heating case of FIG. 1 in accordance with exemplary embodiments.
Figure 5:
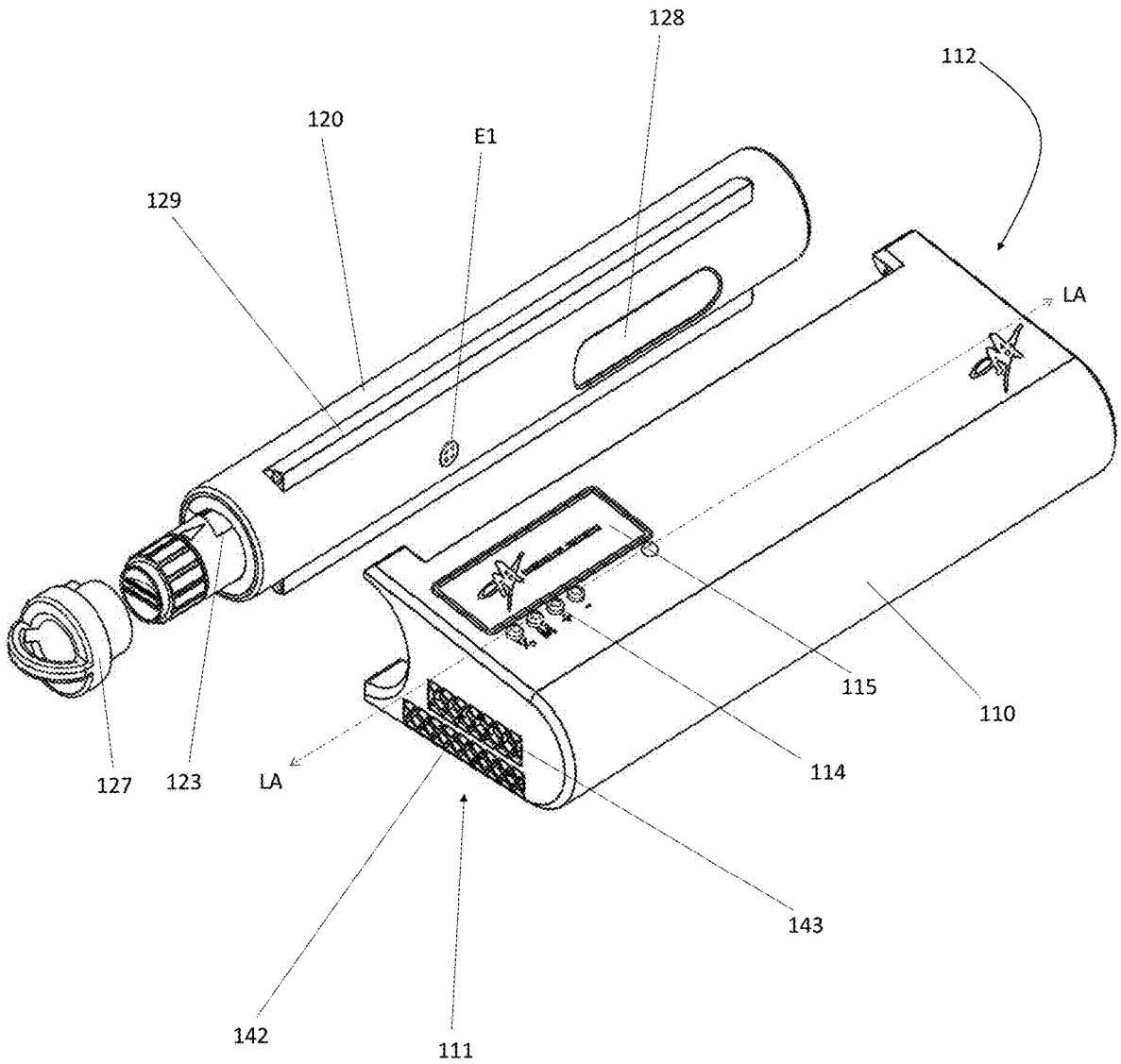
FIG. 5 illustrates an exploded perspective view of the personal thermoelectric-cooling and heating case of FIG. 1, in accordance with exemplary embodiments.
Figure 7:
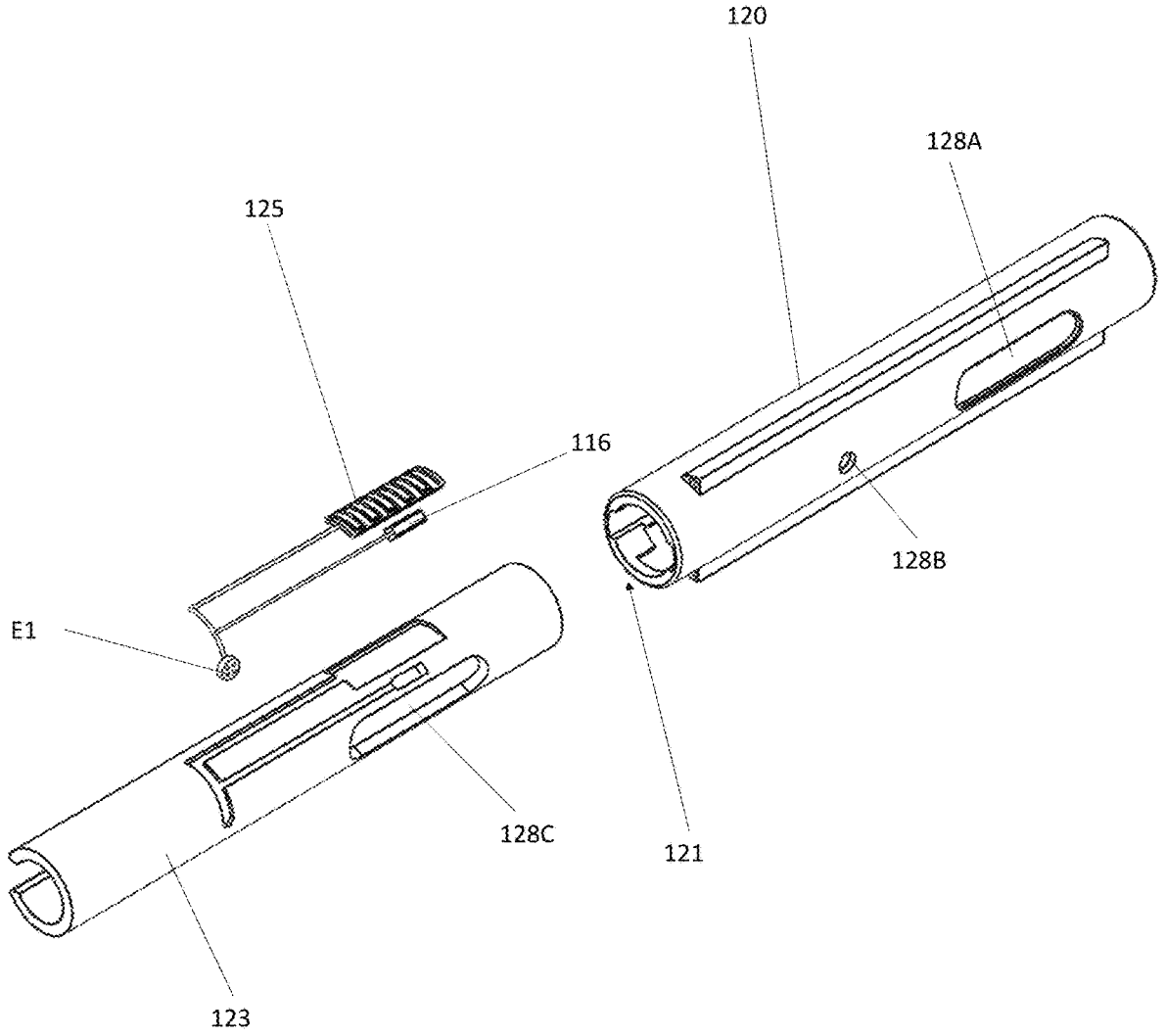
FIG. 7 illustrates a second rigid chamber and bay structure of the personal thermoelectric-cooling and heating case of FIG. 1 including a direct heating element and thermistor in accordance with exemplary embodiments.
Figure 8:
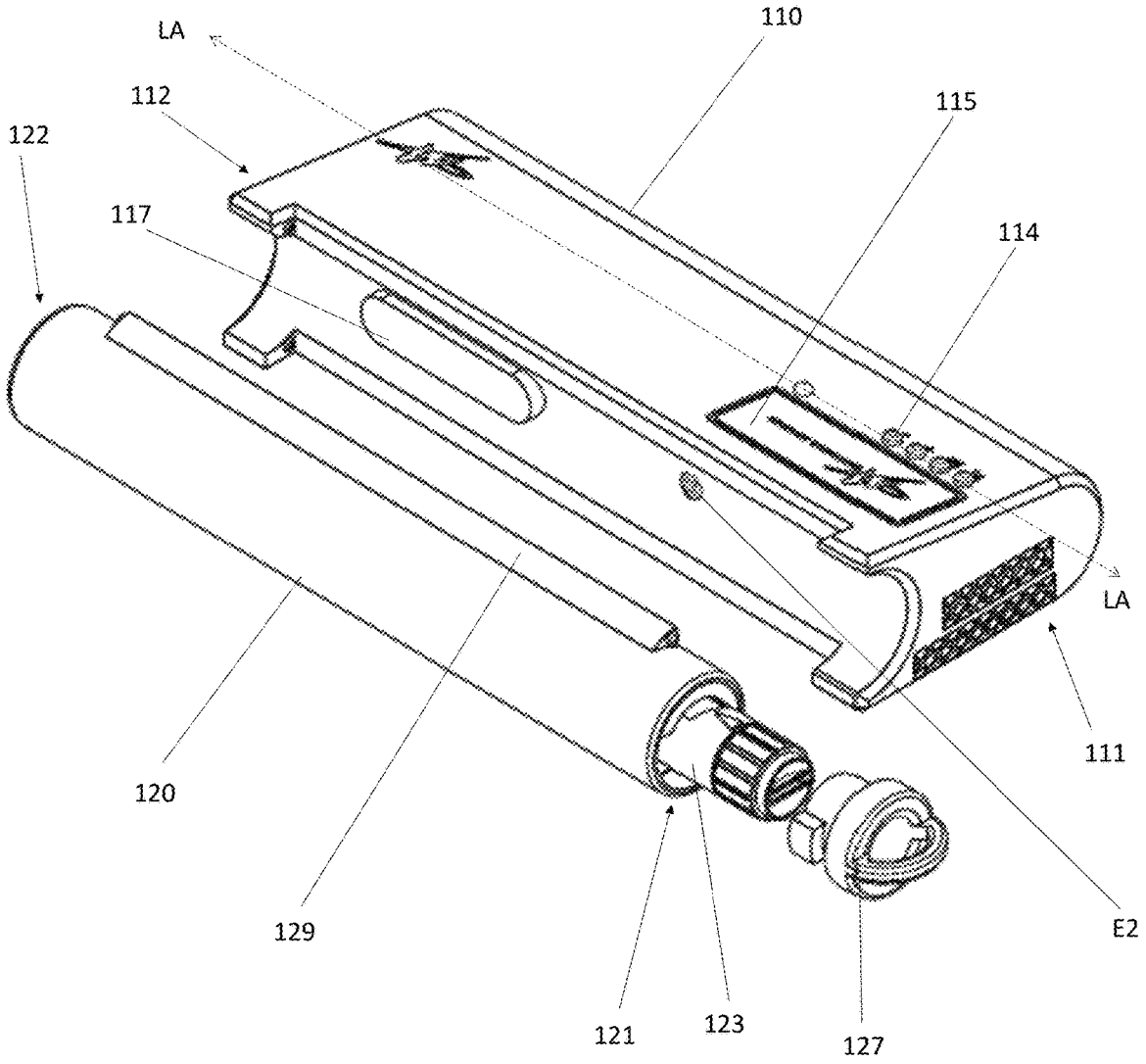
FIG. 8 illustrates an exploded perspective view of the personal thermoelectric-cooling and heating case of FIG. 1, in accordance with exemplary embodiments.

The thermistor 116 (also referred to as a temperature probe or temperature sensor), shown in FIGS. 3, 4 and 7, of the first rigid chamber 110 is in thermal contact with the bay structure 123 of the temperature regulated second rigid chamber 120. The thermistor 116 is configured to measure the temperature of the bay structure 123 and transmit a temperature measure signal (including the measured temperature of the bay structure 123), via electrical contacts E1 and E2 (see, e.g., FIGS. 5-8) to the processor 119 for processing and analysis.

The direct heating element 125 of the temperature regulated second rigid chamber 120, may include a flexible heating plate (e.g., a flexible polyimide heater plate, heating element or plate, or heater cartridge) located within a portion of a periphery of the bay structure 123 and is attached to the bay structure 123 in a non-thermally (e.g. industrial glue) or thermally conductive manner, including, for example, intermediately positioned thermal paste, thermal epoxy, solder, etc.

Figure 16:
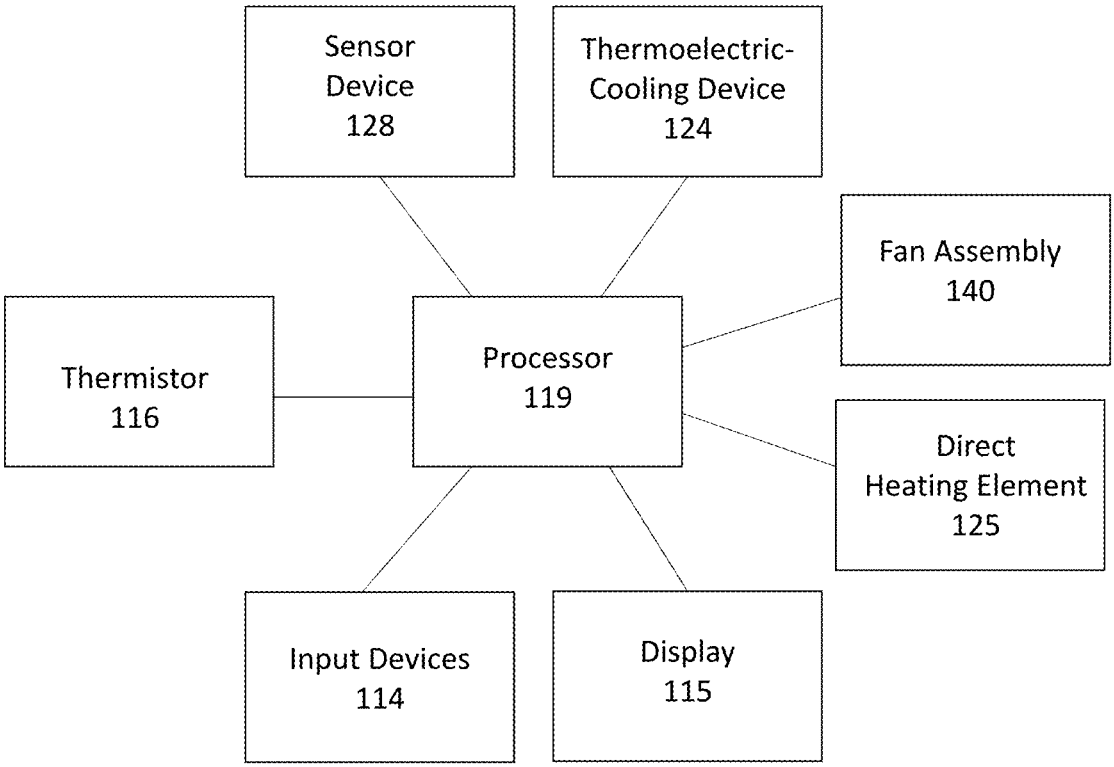
FIG. 16 illustrates an exemplary electrical block diagram of the personal thermoelectric-cooling and heating case of FIG. 1 in accordance with exemplary embodiments.

FIG. 16 illustrates an exemplary electrical block diagram 300 representing the personal thermoelectric-cooling and heating case of FIG. 1 to monitor and control the temperature within the temperature regulated second rigid chamber 120. As depicted, the processor 119 of the first rigid chamber 110 is communicably connected to components of the first rigid chamber 110 including the input devices 114, display 115, thermoelectric-cooling device 124 and fan 126, as well as components of the temperature regulated second rigid chamber 120 including the thermistor 116, direct heating element 125, and the sensor device 128. The processor 119 may further be connected to the battery holder 113A (and removeable battery 113) enabling the processor 119 to provide direct current from the battery 113 to other components of the personal thermoelectric-cooling and heating case 100. The processor 119 may also be connected to a transmitter/receiver device (not shown) of the first rigid chamber 112 and configured to transmit data and receive data from a mobile application of mobile computing device that is configured to track the temperature of the bay structure 123, change the temperature (e.g., temperature range) stored in the memory of the processor 119 (discussed below), track whether an item (e.g., medicament) is in the bay structure, etc. The processor 119 may be further configured to initiate an alert, via an alerting mechanism, to alert the user when he/she is in need of a prescription refill and to automatically transmit, via the transmitter/receiver device, a notification to the user's doctor and/or pharmacy for the prescription refill. The transmitter/receiver device may be configured to transmit/receive data over one or more networks via one or more network protocols. In some instances, the transmitter/receiver device may be configured to transmit/receive data via one or more communication methods, such as radio frequency, local area networks, wireless area networks, cellular communication networks, Bluetooth, the Internet, etc.

The memory, of the processor 119, stores temperature values among other data. For example, a user may input, via the input devices 114, a temperature range (including a first threshold value and a second threshold value) within which the bay structure 123 is to be maintained. The processor 119 receives the inputted temperature range from the input devices 114 and stores it in the memory. The thermistor 116 measures the temperature of the bay structure 123 of the temperature regulated second rigid chamber 120 and transmits a temperature measure signal (including the measured temperature of the bay structure 123) to the processor 119. The processor 119 receives the temperature measure signal from the thermistor 116, converts the temperature measure signal to a signal that is then used through programming in the processor 119 to cause either the direct heating element 125 (e.g., Flexible Polyimide heater plate—see, e.g., FIG. 17) or the thermoelectric-cooling device 124 (e.g., Peltier heat pump) to activate. In particular, when the measured temperature in the temperature measure signal is below the first threshold value (e.g., a minimum temperature value) stored in the memory, the processor 119 will cause the direct heating element 125 to activate until the temperature measured by the thermistor 116 is above the first threshold value (e.g., the minimum temperature value) but below the second threshold value (e.g., the maximum threshold value). In other words, the processor 119 will cause the direct heating element to activate and heat the bay structure 123 until the measured temperature is within a predetermined range. Conversely, when the measured temperature in the temperature measure signal is above the second threshold value (e.g., above the maximum temperature value) stored in the memory, the processor 119 will cause the thermoelectric-cooling device 124 (e.g., Peltier heat pump) to cool the bay structure 123 and activate the fan 126 until the temperature measured by the thermistor 116 is below the second threshold value (e.g., the maximum temperature value) but above the first threshold value (e.g., the minimum threshold value). Said another way, the processor 119 will cause the thermoelectric-cooling device 124 to cool the bay structure 123 and activate the fan until the measured temperature is within a predetermined range.

Process for Regulating Temperature

Figure 18:
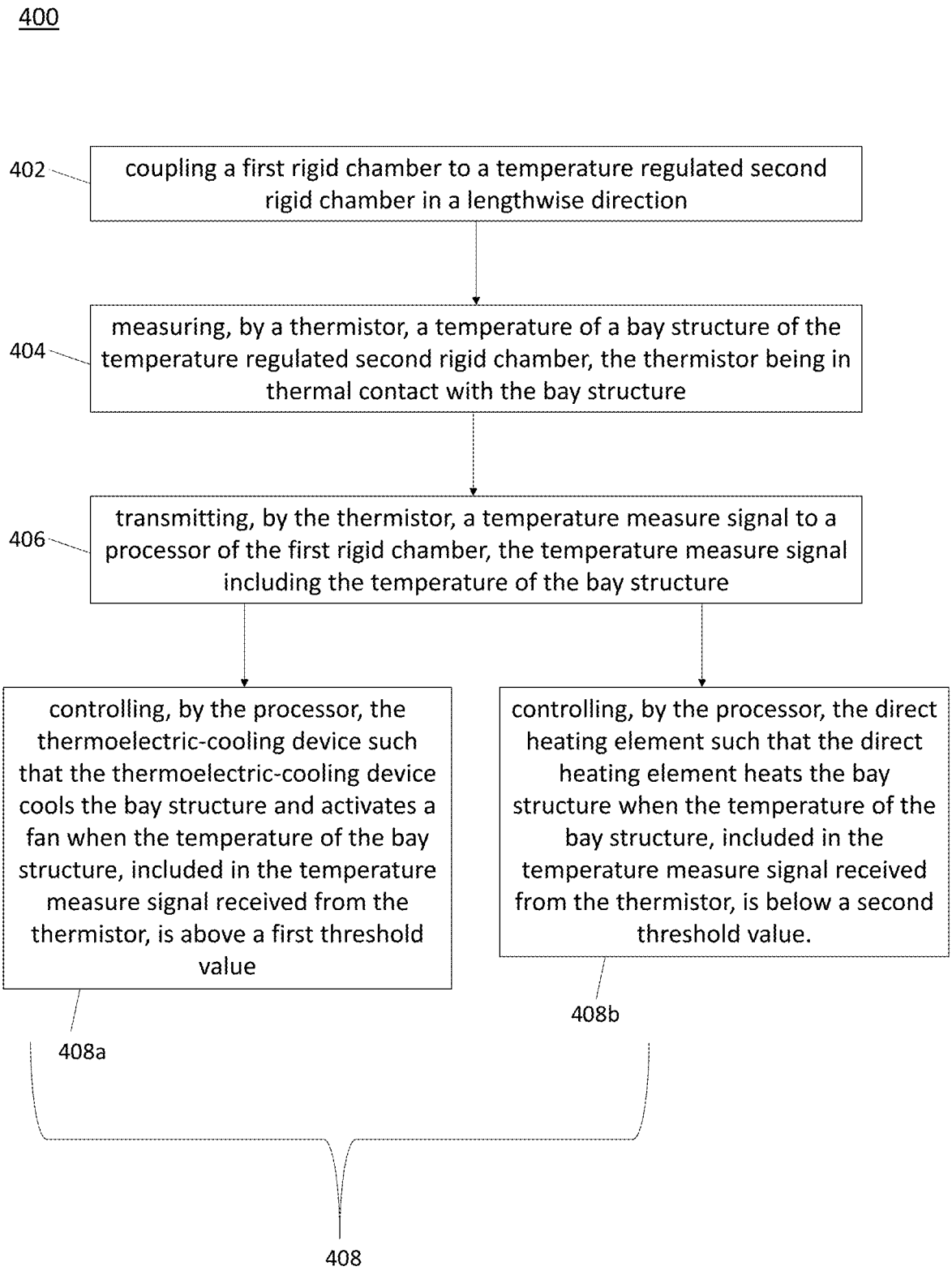
FIG. 18 is a flow chart illustrating an exemplary method for regulating temperature of a personal thermoelectric-cooling and heating case in accordance with exemplary embodiments.

FIG. 18 illustrates an example process 400 for regulating temperature of the personal thermoelectric-cooling and heating case 100 of FIG. 1.

In step 402, the first rigid chamber 120, configured to accommodate electronic circuitry, is removeably coupled to the temperature regulated second rigid chamber 120 in a lengthwise direction. For example, the first rigid chamber 110 and the temperature regulated second rigid chamber 120 may be removeably coupleable via a snap-type mechanism. In particular, in such embodiments, the first rigid chamber 110 and the temperature regulated second rigid chamber 120 may be formed of parts that snap together through interlocking flanges, or the like, to prevent casual opening. Alternatives can include other mechanical fasteners such as screws, bolts, slide connections (e.g. the first and second chambers have male and female slides for e.g., sliding together in an axial direction with a snap or detent to keep them from freely sliding once in place), cords and belt clamps, magnets (e.g., rare earth, matching magnets or magnet and matching ferrous metal plate or surface), shrink-wrap, and nearly any other mechanism or combination of mechanisms for detachably attaching the first and second chambers. One would balance the difficulty in attaching and detaching the first and second chambers with the secureness of the coupling, but in normal applications it should resist when, e.g., in a pocket or otherwise confined space it would not come apart in normal use.

In step 404, the thermistor 116, which is in thermal contact with the bay structure 123 of the temperature regulated second rigid chamber 120, measures a temperature of the bay structure 123.

In step 406, the thermistor 116 transmits a temperature measure signal, which includes the measured temperature of the bay structure 123, to the processor 119 of the first rigid chamber 110 for processing and analysis.

In step 408, the processor 119, at 408*a*, controls the thermoelectric-cooling device 124 such that the thermoelectric-cooling device 124 cools the bay structure 123 and activates a fan 126 when the temperature of the bay structure 123, included in the temperature measure signal received from the thermistor 116, is above a first threshold value, and at 408*b*, controls the direct heating element 125 such that the direct heating element 123 heats the bay structure 123 when the temperature of the bay structure 123, included in the temperature measure signal received from the thermistor 116, is below a second threshold value.

In some embodiments, the process may further include the input devices 114 of the first rigid chamber 110 receiving user inputs including at least a power setting of the personal thermoelectric-cooling and heating case 100 and a temperature setting of the bay structure 123, and the display 115 displaying the user inputs received by the input devices 114.

In other embodiments, the process may further include the sensor device 128 (see, e.g., FIG. 16) of the bay structure 123 detecting when an item is not housed therein. In response to detecting that an item is not housed in the bay structure 123, the sensor device 128 transmits a first signal to the processor 119. And, upon receiving the first signal from the sensor device 128, the processor 119 transmits a second signal to the thermoelectric-cooling device 124 and the direct heating element 125 to stop heating or cooling the bay structure 123.

While various exemplary embodiments of the disclosed system and method have been described above it should be understood that they have been presented for purposes of example only, not limitations. It will be apparent to those of ordinary skill in the art that many more embodiments and implements are possible within the scope of this invention. For example, the personal thermoelectric-cooling and heating case 100, via the processor 119, may be further configured to export data regarding usage and/or diagnostics and connect to/communicate with monitoring devices that would alert the user whether his/her blood sugar is too high. The personal thermoelectric-cooling and heating case 100 may be configured to track the milligram usage according to weight of a medicament housed in the bay structure (e.g., via a sensor). For example the personal thermoelectric-cooling and heating case 100 may include such a sensor that self-weighs the entire case 100 and subtracts a tare value (weight of the case when the bay structure 123 is empty) to detect the weight of the remaining medicament. The personal thermoelectric-cooling and heating case 100 may further include a pressure sensor (not shown) on the bay structure 123 to assist in determining whether the bay structure 123 is being cooled sufficiently. The personal thermoelectric-cooling and heating case 100 may further include a hazmat reservoir. Because Insulin pens have removable cap-style needles that are interchangeable between uses, the hazmat reservoir would be used to store fresh or used needles securely so they can be disposed of appropriately. In the case of housing vials or an injection pen, the bay structure 123 may be filled with a gel to aid in the cooling of the vials or the injection pen and extend the length of time the bay structure 123 remains cool or warm. The personal thermoelectric-cooling and heating case 100 may be further configured to turn off the display and lights when the case 100 is not in use for a predetermined period of time and to further initiate an alarm for low battery. It is not exhaustive and does not limit the disclosure to the precise form disclosed. Modifications and variations are possible in light of the above teachings or may be acquired from practicing of the disclosure, without departing from the breadth or scope.

What is claimed is:

1. A personal thermoelectric-cooling and heating case, comprising:

a first rigid chamber configured to accommodate electronic circuitry, said first rigid chamber extends lengthwise along a longitudinal axis and includes a first end portion, a second end portion, and a thermoelectric-cooling device; and a temperature regulated second rigid chamber including a bay structure configured to accommodate an item that is subject to temperature regulation, said temperature regulated second rigid chamber (i) extends lengthwise along a longitudinal axis and includes a first end portion and a second end portion, (ii) is removeably coupleable to the first rigid chamber in a lengthwise direction, and (iii) includes a direct heating element thermally coupled to the bay structure, wherein said first rigid chamber and said temperature regulated second rigid chamber together form a housing that is a bifurcated structure with a first part formed by the first rigid chamber and a second part formed by the temperature regulated second rigid chamber.

2. The personal thermoelectric-cooling and heating case of claim 1, wherein the temperature regulated second rigid chamber further includes a thermistor, and the first rigid chamber further includes a processor, and wherein said thermistor is in thermal contact with the bay structure and is configured to (i) measure a temperature of the bay structure of the temperature regulated second rigid chamber, and (ii) transmit a temperature measure signal to the processor, said temperature measure signal includes the temperature of the bay structure.

3. The personal thermoelectric-cooling and heating case of claim 2, wherein the processor is configured to cause the thermoelectric-cooling device to cool the bay structure and activate a fan when the temperature of the bay structure, included in the temperature measure signal received from the thermistor, is above a first threshold value, and cause the direct heating element to heat the bay structure when the temperature of the bay structure, included in the temperature measure signal received from the thermistor, is below a second threshold value.

4. The personal thermoelectric-cooling and heating case of claim 2, wherein the first rigid chamber further includes (i) input devices configured to receive inputs from a user including at least a power setting of the personal thermoelectric-cooling and heating case and a temperature setting of the bay structure, and (ii) a display.

5. The personal thermoelectric-cooling and heating case of claim 1, wherein the second end portion of first rigid chamber is further configured to house a removeable battery.

6. The personal thermoelectric-cooling and heating case of claim 1, wherein the thermoelectric-cooling device includes a Peltier heat pump.

7. The personal thermoelectric-cooling and heating case of claim 1, wherein the direct heating element is flexible heating plate located within a portion of a periphery of the bay structure of the temperature regulated second rigid chamber.

8. The personal thermoelectric-cooling and heating case of claim 1, wherein the first rigid chamber further includes a fan and a heat dissipating structure.

9. The personal thermoelectric-cooling and heating case of claim 1, wherein the first end portion of the temperature regulated second rigid chamber includes a removeable cap structure configured to seal the bay structure.

10. The personal thermoelectric-cooling and heating case of claim 1, wherein the first rigid chamber and the temperature regulated second rigid chamber are removeably coupleable together via a snap-type mechanism.

11. The personal thermoelectric-cooling and heating case of claim 1, wherein the bay structure includes a sensor device configured to detect when the item is not housed therein, in response to detecting that the item is not housed therein, the sensor device transmits a first signal to the processor, and upon receiving the first signal from the sensor device, the processor transmits a second signal to (i) the thermoelectric-cooling device, and (ii) the direct heating element to cease heating or cooling the bay structure.

12. The personal thermoelectric-cooling and heating case of claim 1, wherein the temperature regulated second rigid chamber includes an insulating membrane around at least a portion of an external periphery thereof.

13. The personal thermoelectric-cooling and heating case of claim 1, wherein said first rigid chamber extends an entire length of said temperature regulated second rigid chamber.

14. A method of regulating temperature of a personal thermoelectric-cooling and heating case, the method comprising:

forming a housing by removeably coupling a first rigid chamber, configured to accommodate electronic circuitry, to a temperature regulated second rigid chamber in a lengthwise direction, wherein the housing is a bifurcated structure with a first part formed by said first rigid chamber and a second part formed by said temperature regulated second rigid chamber, said first rigid chamber extends lengthwise along a longitudinal axis and includes a first end portion, a second end portion, and a thermoelectric-cooling device, said temperature regulated second rigid chamber (i) includes a bay structure configured to accommodate an item that is subject to temperature regulation, (ii) extends lengthwise along a longitudinal axis and includes a first end portion and a second end portion, and (iii) includes a direct heating element thermally coupled to the bay structure; and measuring, by a thermistor, a temperature of the bay structure of the temperature regulated second rigid chamber, said thermistor being in thermal contact with the bay structure.

15. The method of claim 14 further comprising:

transmitting, by the thermistor, a temperature measure signal to a processor of the first rigid chamber, said temperature measure signal including the temperature of the bay structure.

16. The method of claim 15 further comprising:

controlling, by the processor, the thermoelectric-cooling device and a fan such that the thermoelectric-cooling device cools the bay structure and the fan blows air toward a heat dissipating structure when the temperature of the bay structure, included in the temperature measure signal received from the thermistor, is above a first threshold value, and controlling, by the processor, the direct heating element such that the direct heating element heats the bay structure when the temperature of the bay structure, included in the temperature measure signal received from the thermistor, is below a second threshold value.

17. The method of claim 16, further comprising:

detecting, by a sensor device, when the item is not housed in the bay structure;

in response to detecting that the item is not housed therein, transmitting a first signal to the processor, and upon receiving the first signal from the sensor device, transmitting, by the processing device, a second signal to (i) the thermoelectric-cooling device, and (ii) the direct heating element to cease heating or cooling the bay structure.

18. The method of claim 14 further comprising:

receiving, by input devices of the first rigid chamber, user inputs including at least a power setting of the personal thermoelectric-cooling and heating case and a temperature setting of the bay structure, and displaying, on a display device of the first rigid chamber, the user inputs received by the input devices.

19. The method of claim 14, wherein said first rigid chamber extends an entire length of said temperature regulated second rigid chamber.

* * * * *